US010861389B2

(12) United States Patent
Lin et al.

(10) Patent No.: US 10,861,389 B2
(45) Date of Patent: Dec. 8, 2020

(54) METHODS AND APPARATUS FOR MITIGATING HYSTERESIS IMPACT ON CURRENT SENSING ACCURACY FOR AN ELECTRONIC DISPLAY

(71) Applicant: Apple Inc., Cupertino, CA (US)

(72) Inventors: Chin-Wei Lin, San Jose, CA (US); Shinya Ono, Cupertino, CA (US); Zino Lee, Pajn-si (KR)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/536,221

(22) Filed: Aug. 8, 2019

(65) Prior Publication Data

US 2020/0051500 A1 Feb. 13, 2020

Related U.S. Application Data

(60) Provisional application No. 62/716,290, filed on Aug. 8, 2018.

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/043* (2013.01)

(58) Field of Classification Search
CPC ..... G09G 3/3233; G09G 3/3258; G09G 2320/0295; G09G 2300/0819; G09G 3/3225; G09G 2320/045; G09G 2300/043
See application file for complete search history.

(56) References Cited

U.S. PATENT DOCUMENTS

| | | | | |
|---|---|---|---|---|
| 8,648,848 | B2 | 2/2014 | Tsai et al. | |
| 2014/0300281 | A1* | 10/2014 | Chaji | G09G 3/3233 315/161 |
| 2016/0104427 | A1* | 4/2016 | Matsueda | G09G 3/3233 345/212 |
| 2016/0163278 | A1 | 6/2016 | Pappas et al. | |
| 2017/0278459 | A1 | 9/2017 | Jeon | |
| 2018/0033372 | A1* | 2/2018 | Kishi | G09G 3/3258 |

(Continued)

FOREIGN PATENT DOCUMENTS

EP 2852947 B1 7/2018

*Primary Examiner* — Muhammad N Edun
(74) *Attorney, Agent, or Firm* — Treyz Law Group, P.C.; Jason Tsai

(57) ABSTRACT

A display may include an array of organic light-emitting diode display pixels having transistors characterized by threshold voltages subject to transistor variations. Compensation circuitry may be used to sense a current from selected display pixels. A display pixel may include a drive transistor, a gate setting transistor for driving a reference voltage onto the gate terminal of the drive transistor, a data loading and current sensing transistor for connecting the drive transistor to a data/current-sensing line, a light-emitting diode, an emission control transistor coupled between the drive transistor and the diode, and an anode resetting transistor for selectively resetting the anode terminal of the diode. During pixel conditioning and current sensing operations, the anode resetting transistor may be constantly turned on to ensure that there is no voltage perturbation at the source terminal of the drive transistor, which can help prevent hysteresis-induced current sensing error.

20 Claims, 17 Drawing Sheets

(56) References Cited

U.S. PATENT DOCUMENTS

| | | | | |
|---|---|---|---|---|
| 2018/0075798 | A1* | 3/2018 | Nho | G09G 3/3233 |
| 2018/0158415 | A1* | 6/2018 | Chaji | G09G 3/3233 |
| 2019/0103055 | A1 | 4/2019 | Gao | |
| 2019/0130846 | A1 | 5/2019 | Chung et al. | |
| 2019/0147796 | A1 | 5/2019 | Rha et al. | |
| 2019/0154439 | A1 | 5/2019 | Binder | |
| 2019/0259325 | A1 | 8/2019 | Chaji et al. | |

* cited by examiner

METHODS AND APPARATUS FOR MITIGATING HYSTERESIS IMPACT ON CURRENT SENSING ACCURACY FOR AN ELECTRONIC DISPLAY

This application claims the benefit of provisional patent application No. 62/716,290, filed Aug. 8, 2018, which is hereby incorporated by reference herein in its entirety.

BACKGROUND

This relates generally to electronic devices with displays and, more particularly, to display driver circuitry for displays such as organic-light-emitting diode displays.

Electronic devices often include displays. For example, cellular telephones and portable computers include displays for presenting information to users.

Displays such as organic light-emitting diode displays have an array of display pixels based on light-emitting diodes. In this type of display, each display pixel includes a light-emitting diode and thin-film transistors for controlling application of a signal to the light-emitting diode to produce light.

An organic light-emitting diode display pixel includes a drive thin-film transistor connected to a data line via an access thin-film transistor. The access transistor may have a gate terminal that receives a scan signal via a corresponding scan line. Image data on the data line can be loaded into the display pixel by asserting the scan signal to turn on the access transistor. The display pixel includes a current source transistor that provides current to the organic light-emitting diode to produce light.

Transistors in an organic light-emitting diode display pixel may be subject to process, voltage, and temperature (PVT) variations. Due to such variations, transistor threshold voltages between different display pixels may vary. Variations in transistor threshold voltages can cause the display pixels to produce amounts of light that do not match a desired image. Compensation schemes are sometimes used to compensate for variations in threshold voltage. Such compensation schemes typically involve sampling operations that are performed within each pixel during normal display operations and thus increase the time required to display images.

It is within this context that the embodiments herein arise.

SUMMARY

An electronic device may include a display having an array of display pixels. The display pixels may be organic light-emitting diode display pixels. Each display pixel may have an organic light-emitting diode that emits light. A drive transistor (i.e., a current source transistor) in each display pixel may apply current to the organic light-emitting diode in that display pixel. The drive transistor may be characterized by a threshold voltage that is subject to random variations. Compensation circuitry may be used to measure sensing current from the drive transistor, to compare the sensing current to a predetermined current level, and to apply external compensation to the display pixel based on the comparison.

The display pixel may include an organic light-emitting diode, a drive transistor coupled in series with the organic light-emitting diode, an anode reset transistor directly coupled to the anode of the organic light-emitting diode, a data line, and a current sensing transistor coupled between the data line and the source terminal of the drive transistor.

The anode reset transistor may be configured to drive the source terminal of the drive transistor to a given voltage during pixel conditioning operations. The current sensing transistor may be configured to output sensing current onto the data line during current sensing operations while the data line is biased to the given voltage to reduce hysteresis-induced current sensing error.

In one suitable arrangement, the given voltage is identical to the power supply voltage that is received directly at the cathode of the organic light-emitting diode. In this arrangement, the anode reset transistor has a source terminal coupled to the anode of the organic light-emitting diode and a drain terminal coupled to the cathode of the organic light-emitting diode. In another suitable arrangement, the give voltage is identical to the reference voltage that is supplied on a column reference voltage line. In this arrangement, the anode reset transistor has a source terminal coupled to the reference voltage line and a drain terminal coupled to the anode of the organic light-emitting diode. Configured in these ways, the voltage at the source terminal of the drive transistor remains unperturbed when the display pixel transitions from the pixel conditioning operations to the current sensing operations, thus eliminating hysteresis-induced current sensing error.

DETAILED DESCRIPTION

Figure 1:
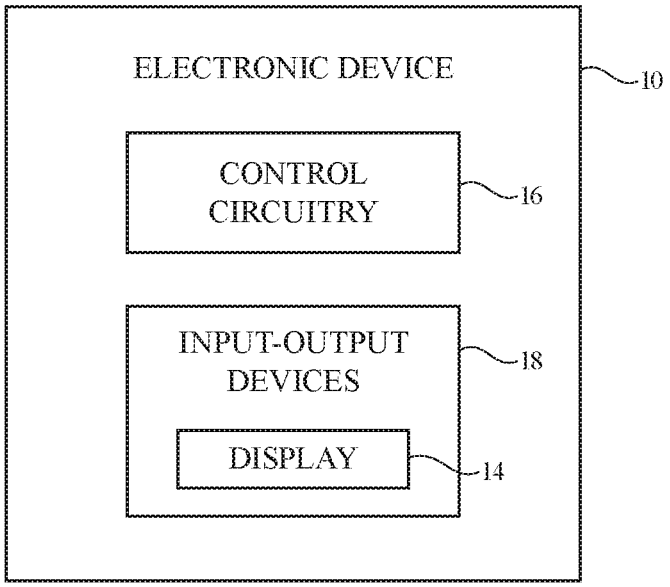
FIG. 1 is a diagram of an illustrative electronic device having a display in accordance with an embodiment.

An illustrative electronic device of the type that may be provided with an organic light-emitting diode (OLED) display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio codec chips, application specific integrated circuits, programmable integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 in input-output devices.

Figure 2:
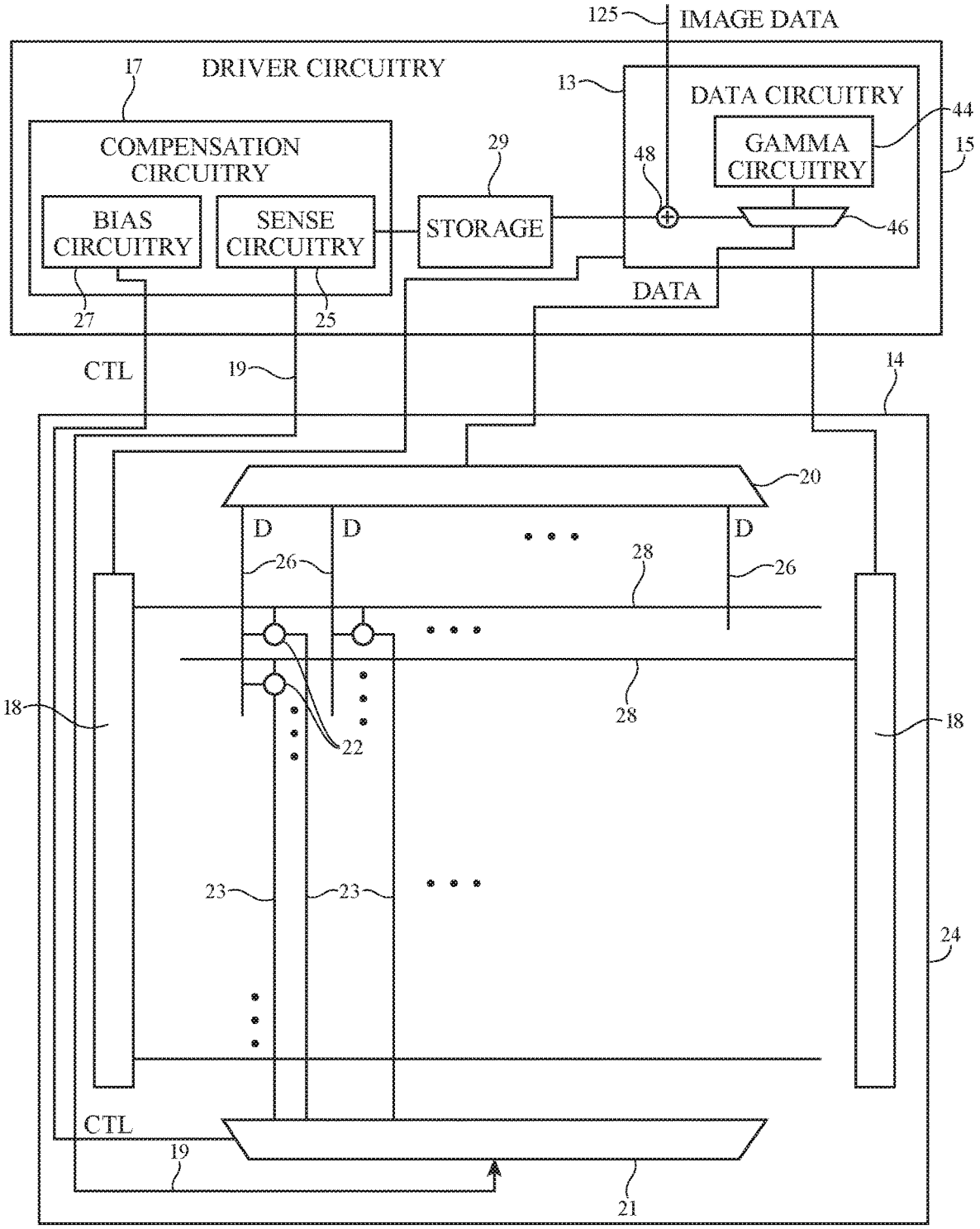
FIG. 2 is a diagram of an illustrative display having an array of organic light-emitting diode display pixels coupled to compensation circuitry in accordance with an embodiment.

FIG. 2 shows display 14 and associated display driver circuitry 15. Display 14 includes structures formed on one or more layers such as substrate 24. Layers such as substrate 24 may be formed from planar rectangular layers of material such as planar glass layers. Display 14 may have an array of display pixels 22 for displaying images to a user. The array of display pixels 22 may be formed from rows and columns of display pixel structures on substrate 24. These structures may include thin-film transistors such as polysilicon thin-film transistors, semiconducting oxide thin-film transistors, etc. There may be any suitable number of rows and columns in the array of display pixels 22 (e.g., ten or more, one hundred or more, or one thousand or more).

Display driver circuitry such as display driver integrated circuit 15 may be coupled to conductive paths such as metal traces on substrate 24 using solder or conductive adhesive. If desired, display driver integrated circuit 15 may be coupled to substrate 24 over a path such as a flexible printed circuit or other cable. Display driver integrated circuit 15 (sometimes referred to as a timing controller chip) may contain communications circuitry for communicating with system control circuitry 16 over path 125. Path 125 may be formed from traces on a flexible printed circuit or other cable. Control circuitry 16 (see FIG. 1) may be located on a main logic board in an electronic device such as a cellular telephone, computer, television, set-top box, media player, portable electronic device, or other electronic equipment in which display 14 is being used.

During operation, the control circuitry may supply display driver integrated circuit 15 with information on images to be displayed on display 14. To display the images on display pixels 22, display driver integrated circuit 15 may supply clock signals and other control signals to display driver circuitry such as row driver circuitry 18 and column driver circuitry 20. For example, data circuitry 13 may receive image data and process the image data to provide pixel data signals to display 14. The pixel data signals may be demultiplexed by column driver circuitry 20 and pixel data signals D may be routed to each pixel 22 over data lines 26 (e.g., to each red, green, or blue pixel). Row driver circuitry 18 and/or column driver circuitry 20 may be formed from one or more integrated circuits and/or one or more thin-film transistor circuits.

Display driver integrated circuit 15 may include compensation circuitry 17 that helps to compensate for variations among display pixels 22 such as threshold voltage variations. Compensation circuitry 17 may, if desired, also help compensate for transistor aging. Compensation circuitry 17 may be coupled to pixels 22 via path 19, switching circuitry 21, and paths 23. Compensation circuitry 17 may include sense circuitry 25 and bias circuitry 27. Sense circuitry 25 may be used in sensing (e.g., sampling) voltages from pixels 22. During sense operations, switching circuitry 21 may be configured to electrically couple sense circuitry 25 to one or more selected pixels 22. For example, compensation circuitry 17 may produce control signal CTL to configure switching circuitry 21. Sense circuitry 25 may sample currents, voltages or other desired signals from the pixels over path 19, switching circuitry 21, and paths 23. Bias circuitry 27 may include one or more driver circuits for driving reference or bias voltages onto nodes of pixels 22. For example, switching circuitry 21 may be configured to electrically couple path 19 to one or more selected pixels 22. In this scenario, bias circuitry 27 may provide reference signals to the selected pixels. The reference signals may bias nodes at the selected pixels at desired voltages for the sensing operations performed by sense circuitry 25.

Compensation circuitry 17 may perform compensation operations on pixels 22 using bias circuitry 27 and sense circuitry 25 to generate compensation data that is stored in storage 29. Storage 29 may, for example, be static random-access memory (SRAM). In the example of FIG. 2, storage 29 is on-chip storage. If desired, storage 29 may be off-chip storage such as non-volatile storage (e.g., non-volatile memory that maintains stored information even when the display is powered off). The compensation data stored in storage 29 may be retrieved by data circuitry 13 during display operations. Data circuitry 13 may process the compensation data along with incoming digital image data to generate compensated data signals for pixels 22.

Data circuitry 13 may include gamma circuitry 44 that provides a mapping of digital image data to analog data signals at appropriate voltage levels for driving pixels 22. Multiplexer 46 receives a set of possible analog data signals from gamma circuitry 44 and is controlled by the digital image data to select an appropriate analog data signal for the digital image data. Compensation data retrieved from storage 29 may be added to (or subtracted from) the digital image data by adder circuit 48 to help compensate for transistor variations (e.g., threshold voltage variations, transistor aging variations, or other types of variations) between different display pixels 22. This example in which compensation data is added as an offset to digital input image data is merely illustrative. In general, data circuitry 13 may process compensation data along with image data to produce compensated analog data signals for driving pixels 22.

In contrast to techniques that focus on performing in-pixel threshold canceling (such as by performing a reset phase followed by a threshold compensation phase), performing sensing and compensation in this way using compensation circuitry 17 outside of each pixel 22 allows for higher refresh rates (e.g., greater than 60 Hz refresh rate, at least 120 Hz refresh rate, etc.) and is sometimes referred to as "external" compensation. External variation compensation may be performed in the factory, in real time (e.g., during blanking intervals between successive image frames), or when the display is idle (as examples).

Row driver circuitry 18 may be located on the left and right edges of display 14, on only a single edge of display 14, or elsewhere in display 14. During operation, row driver circuitry 18 may provide row control signals on horizontal lines 28 (sometimes referred to as row lines, "scan" lines, and/or "emission" lines). Row driver circuitry 18 may include scan line driver circuitry for driving the scan lines and emission line driver circuitry for driving the emission lines.

Demultiplexing circuitry 20 may be used to provide data signals D from display driver integrated circuit (DIC) 15 onto a plurality of corresponding vertical lines 26. Demultiplexing circuitry 20 may sometimes be referred to as column driver circuitry, data line driver circuitry, or source driver circuitry. Vertical lines 26 are sometimes referred to as data lines. During display operations, display data may be loaded into display pixels 22 using lines 26.

Each data line 26 is associated with a respective column of display pixels 22. Sets of horizontal signal lines 28 run horizontally across display 14. Each set of horizontal signal lines 28 is associated with a respective row of display pixels 22. The number of horizontal signal lines in each row is determined by the number of transistors in the display pixels 22 that are being controlled independently by the horizontal signal lines. Display pixels of different configurations may be operated by different numbers of scan lines.

Row driver circuitry 18 may assert control signals such as scan and emission signals on the row lines 28 in display 14. For example, driver circuitry 18 may receive clock signals and other control signals from display driver integrated circuit 15 and may, in response to the received signals, assert scan control signals and an emission control signal in each row of display pixels 22. Rows of display pixels 22 may be processed in sequence, with processing for each frame of image data starting at the top of the array of display pixels and ending at the bottom of the array (as an example). While the scan lines in a row are being asserted, control signals and data signals that are provided to column driver circuitry 20 by DIC 15 may direct column driver circuitry 20 to demultiplex and drive associated data signals D (e.g., compensated data signals provided by data circuitry 13) onto data lines 26 so that the display pixels in the row will be programmed with the display data appearing on the data lines D. The display pixels can then display the loaded display data.

The external pixel compensation scheme described above may involve using sense circuitry 25 to perform current sensing on selected display pixels. In general, the amount of emission current flowing through each display pixel is dependent on the threshold voltage of a "drive" thin-film transistor within that display pixel. The threshold voltage of the drive transistor may also vary depending on the current value of the gate-to-source voltage Vgs of the drive transistor. For example, the drive transistor threshold voltage may exhibit a first average level when Vgs is being raised from low to high, but may exhibit a second average level that is different than the first average level when Vgs is being lowered from high to low, thus yielding different current-voltage (I-V) characteristic curves. This dependence of the threshold voltage on the actual Vgs value is sometimes referred to as transistor "hysteresis," and if care is not taken, this hysteresis can negatively impact the accuracy of the current sensing operations performing by circuitry 25.

Figure 3A:
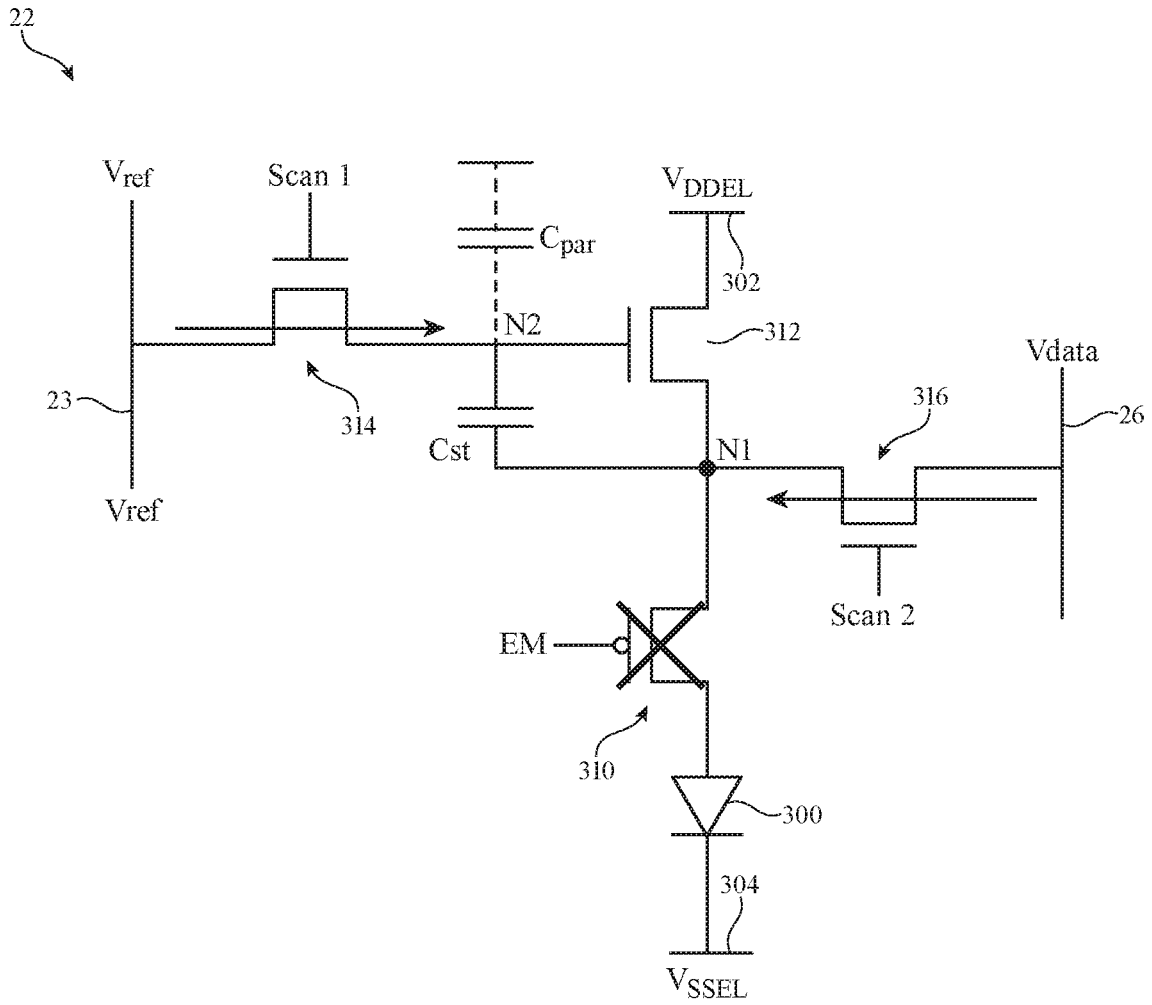
FIG. 3A shows a first snapshot of a given display pixel that is being programmed with sensing data during pixel conditioning operations.
Figure 3B:
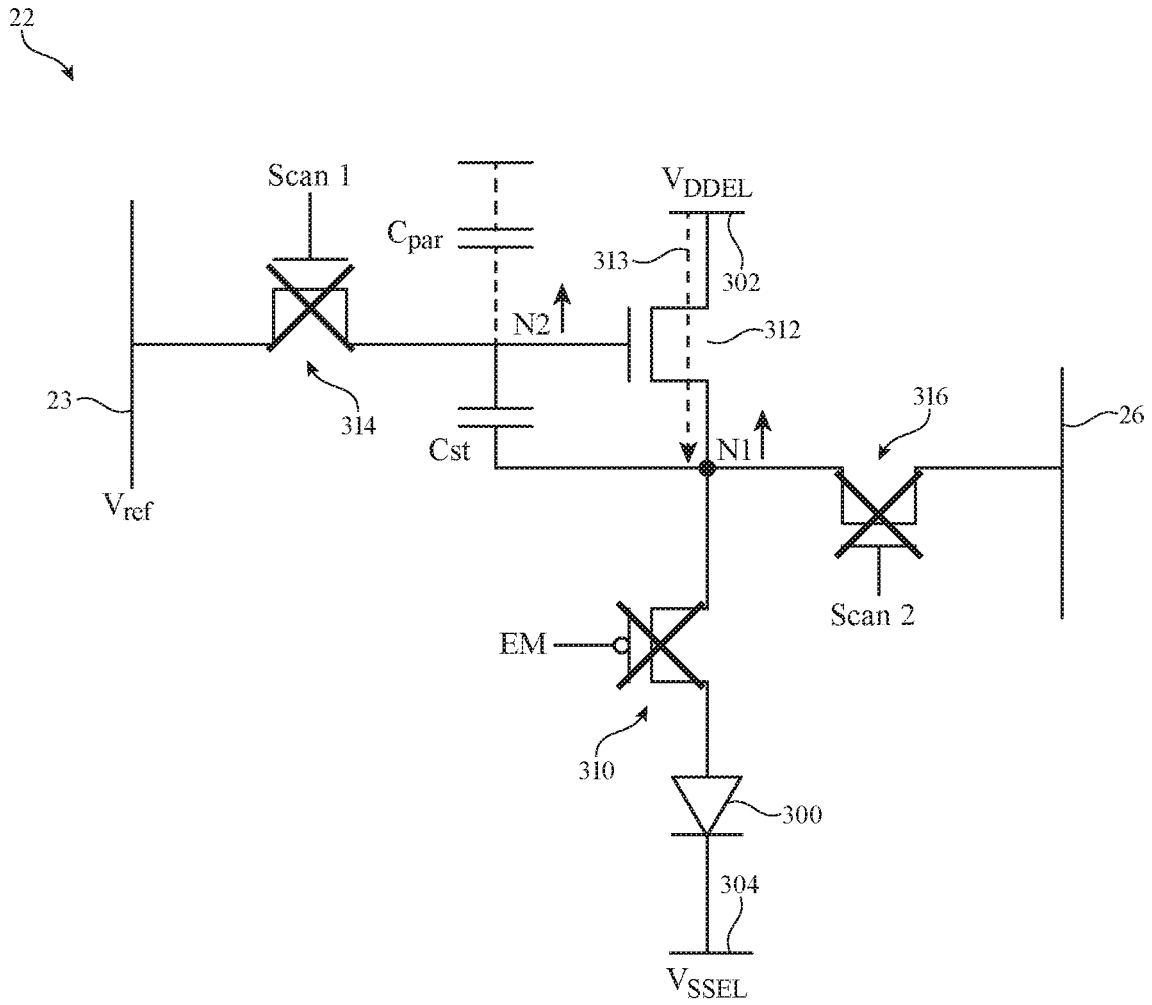
FIG. 3B shows a second snapshot of the given display pixel during pixel conditioning operations.
Figure 3C:
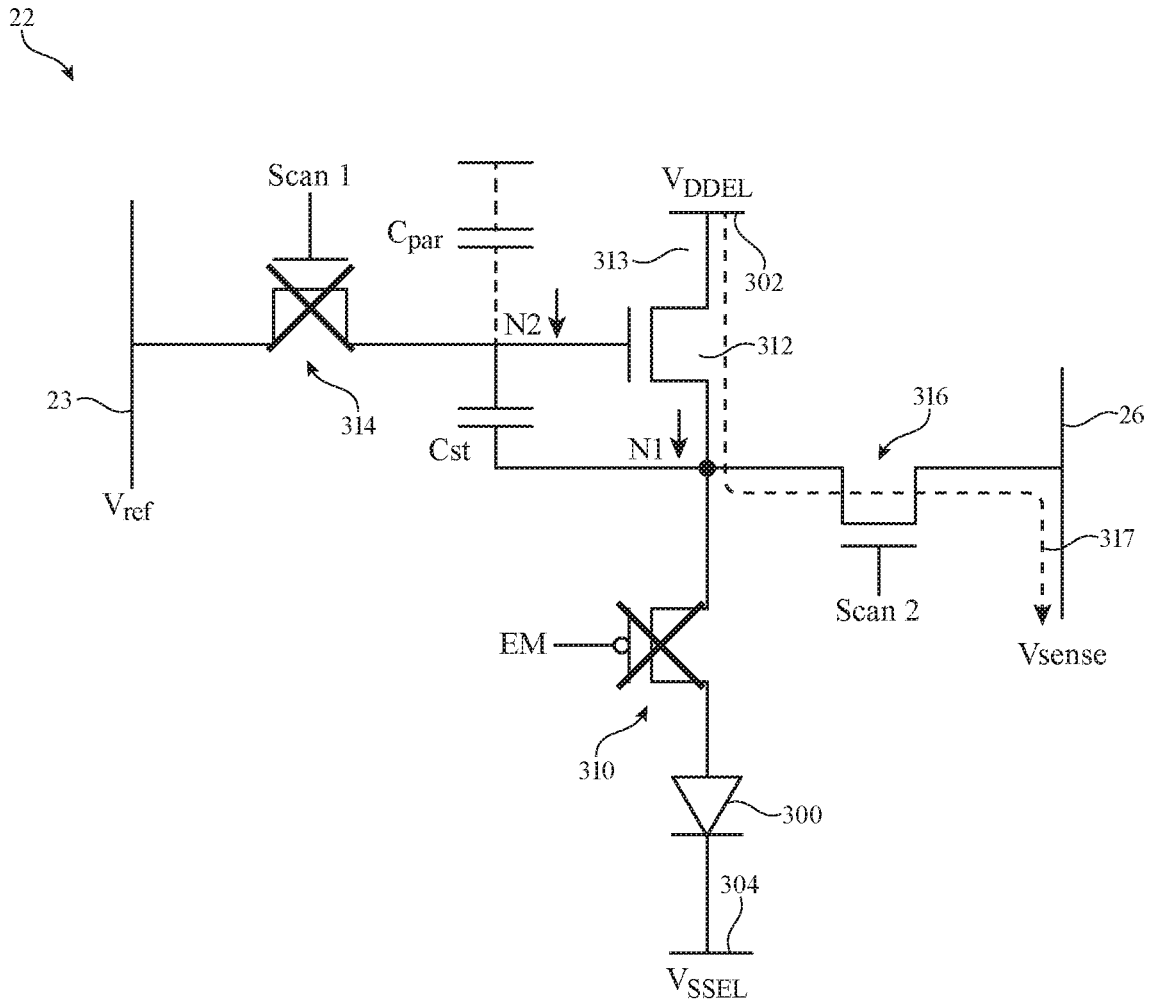
FIG. 3C shows a third snapshot of the given display pixel during current sensing operations.

FIGS. 3A-3C show different snapshots of a display pixel 22 that might suffer from hysteresis-induced error during pixel conditioning and current sensing operations. As shown in FIG. 3A, pixel 22 includes an organic light-emitting diode (OLED) 300, n-channel thin-film transistors 312, 314, and 316, p-channel thin-film transistor 310, and storage capacitor Cst. In particular, transistor 312 is sometimes referred to as the "drive" transistor since the amount of voltage stored across the gate and source terminals of transistor 312 determines the amount of current that is allowed to flow through diode 300.

Transistors 312 and 310 and diode 300 may be coupled in series between a first power supply line 302 (e.g., a positive power supply line on which positive power supply voltage VDDEL is provided) and a second power supply line 304 (e.g., a ground power supply line on which ground voltage VSSEL is provided). Transistor 310 has a gate terminal that receives an emission control signal EM provided over an emission control line. Transistor 310 is therefore sometimes referred to as an emission control transistor. Storage capacitor Cst may have first and second terminals that are coupled to the gate and source terminals of drive transistor 312, respectively. Additional parasitic capacitance that is coupled to the gate terminal of transistor 312 is lumped together and collectively represented as capacitance Cpar in FIG. 3A.

Transistor 314 may be coupled between column line 23 (e.g., a shared path on which a reference voltage Vref is provided to each pixel 22 along a given column) and the gate terminal of drive transistor 312. The gate terminal of drive transistor 312 is marked as node N2. Transistor 314 has a gate terminal that receives a first scan control signal Scan1 via a first scan control line and is selectively turned on to set the gate voltage of drive transistor 312 to a predetermined voltage level (e.g., to voltage level Vref). Transistor 314 is therefore sometimes referred to as a gate voltage setting transistor.

Transistor 316 may be coupled between column line 26 (e.g., a data line that is coupled to column driver circuitry 20) and the source terminal of drive transistor 312. The source terminal of drive transistor 312 is marked as node N1. Transistor 316 has a gate terminal that receives a second scan control signal Scan2 via a second scan control line and is selectively turned on to load a data signal into pixel 22. Transistor 316 is therefore sometimes referred to as a data loading transistor.

Prior to sensing, display pixel 22 has to be first preconditioned with the desired data value. FIG. 3A illustrates the first phase of pixel conditioning during which sensing data is programmed into pixel 22 (i.e., the data programming phase of pixel conditioning operations). During this phase, emission transistor 310 is turned off by deasserting emission control signal EM (i.e., by driving EM high since transistor 310 is active low) while transistor 314 is turned on to bias node N2 to voltage level Vref (i.e., by asserting scan control signal Scan1) and while transistor 316 is turned on to bias node N1 to load data voltage Vdata onto node N1 (i.e., by asserting scan control signal Scan2). Configured in this way, a certain amount of voltage is stored across the gate and source terminals of transistor 312 across capacitor Cst.

FIG. 3B illustrates the second phase of pixel conditioning during which transistors 314 and 316 are turned off (i.e., by deasserting scan control signals Scan1 and Scan2), and pixel 22 just waits for a certain amount of time to let the voltages stabilize within that pixel before sensing. As shown in FIG. 3B, when transistors 310, 314, and 316 are all turned off, current will flow through drive transistor 312 to charge node N1 towards positive power supply voltage VDDEL (as indicated by current path 313). As a result, the voltage at node N1 will increase by a first amount. Since the voltage across capacitor Cst has nowhere to discharge at this time, node N2 will also be pushed upwards. Due to the existence of parasitic capacitance Cpar at node N2 (which acts like a capacitive divider), however, the amount of voltage increase at node N2 will be relatively less than that of node N1. The net result is that the gate-to-source voltage Vgs of drive transistor 312 will actually decrease during this time period after transistors 314 and 316 are shut off.

Pixel conditioning operations will then be followed by current sensing operations (see, FIG. 3C). During sensing operations, transistor 316 will be turned on by asserting scan control signal Scan2 (e.g., by temporarily pulsing Scan2 high). During this time, a sensing voltage Vsense will be applied onto data line 26 (e.g., using bias circuitry 27 of FIG. 2), and a current will flow through transistors 312 and 316 as indicated by current path 313. Assuming Vsense is less than VDDEL (which is generally the case), turning on transistor 316 would cause node N1 is discharge towards Vsense. As a result, the voltage at node N1 will decrease by a third amount. Since the voltage across capacitor Cst still has nowhere to discharge at this time, node N2 will also be pushed downwards. Due to the existence of parasitic capacitance Cpar at node N2 (which acts like a capacitive divider), however, the amount of voltage decrease at node N2 will be relatively less than that of node N1. The net result is that the gate-to-source voltage Vgs of drive transistor 312 will actually increase during this time period after transistor 316 is switched on.

Figure 4:
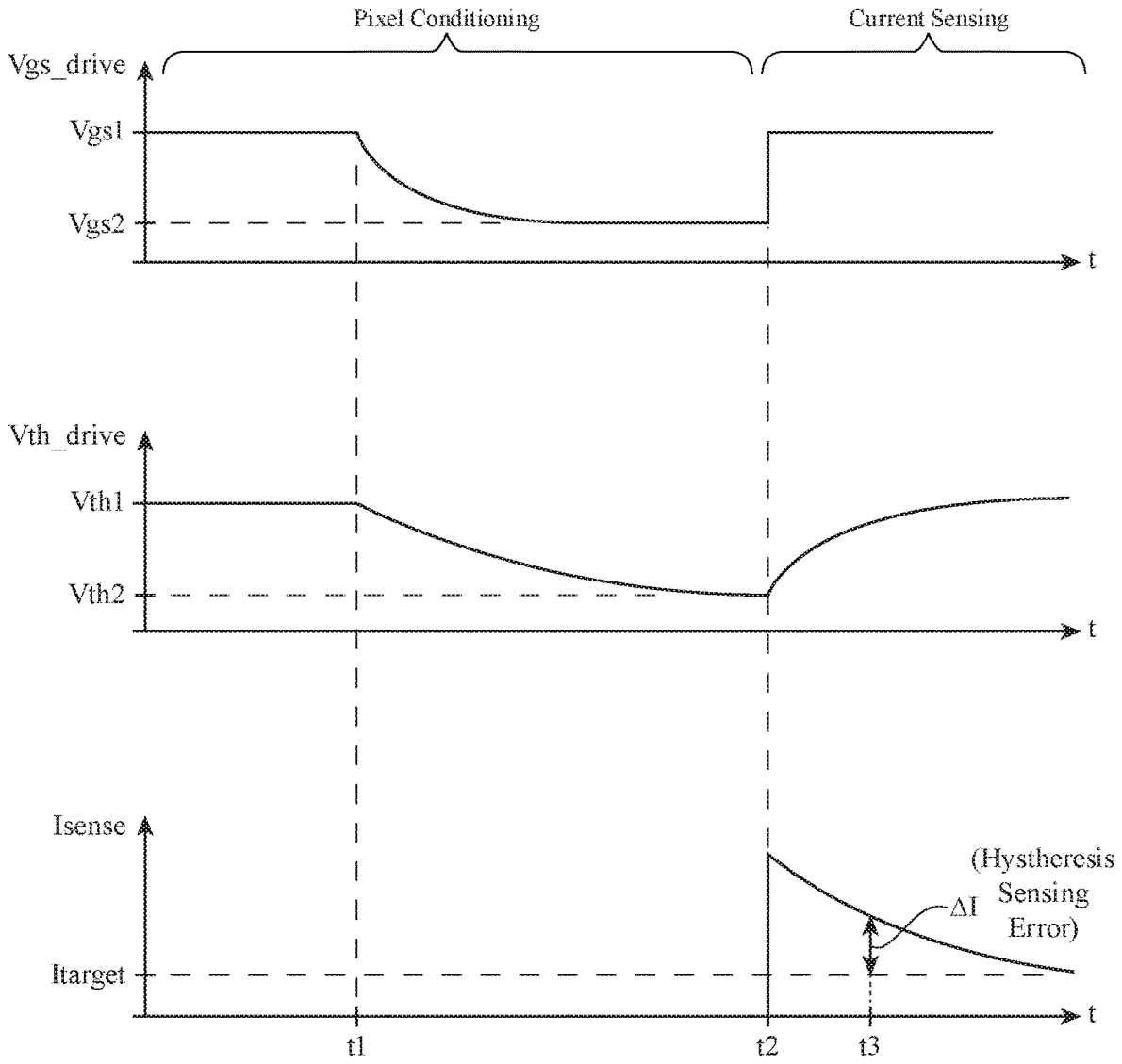
FIG. 4 is a timing diagram illustrating how the given display pixel shown in FIGS. 3A-3C can suffer from hysteresis-induced current sensing error.

FIG. 4 is a timing diagram illustrating how pixel 22 shown in FIGS. 3A-3C can suffer from hysteresis-induced current sensing error. Prior to time t1 (which corresponding to the first phase of the pixel conditional operations shown in FIG. 3A), transistors 314 and 316 are turned on to charge the gate-to-source voltage of the drive transistor Vgs_drive to a first voltage level Vgs1.

At time t1 (which correspond to the second phase of the pixel conditioning operations shown in FIG. 3B), transistors 314 and 316 are turned off, which effectively reduces Vgs_drive to a second voltage level Vgs2, as described above in connection with FIG. 3B. Changing gate-to-source voltage Vgs will also affect the threshold voltage of the drive transistor Vth_drive. As shown in the middle plot of FIG. 4, the drive transistor threshold voltage Vth_drive may fall from a first threshold voltage level Vth1 at time t1 to a second threshold voltage level Vth2 at time t2.

At time t2 (which corresponds to the end of pixel conditioning and the start of current sensing operations), transistor 316 is turned on to discharge node N1 to Vsense. Assuming Vsense is less than VDDEL (which is generally the case), which effectively pushes Vgs_drive to back up towards Vgs1, as described above in connection with FIG. 3C. Even though Vgs_drive can change quickly (as shown in the top plot of FIG. 4), the drive transistor threshold voltage Vth_drive is not able to adjust so abruptly (as shown in the middle plot of FIG. 4 immediately following time t2). As a result, the current being sensed through line 26 will deviate substantially from the target current level Itarget (as shown in the bottom plot of FIG. 4). Assuming current sensing measurements are taken soon after at time t3, there will still be a certain amount of current sensing error ΔI induced by this hysteresis. Hysteresis-induced sensing error can negatively impact the accuracy of current sensing operations and therefore the efficacy of the external compensation scheme performed by compensation circuitry 17 (FIG. 2).

Figure 5A:
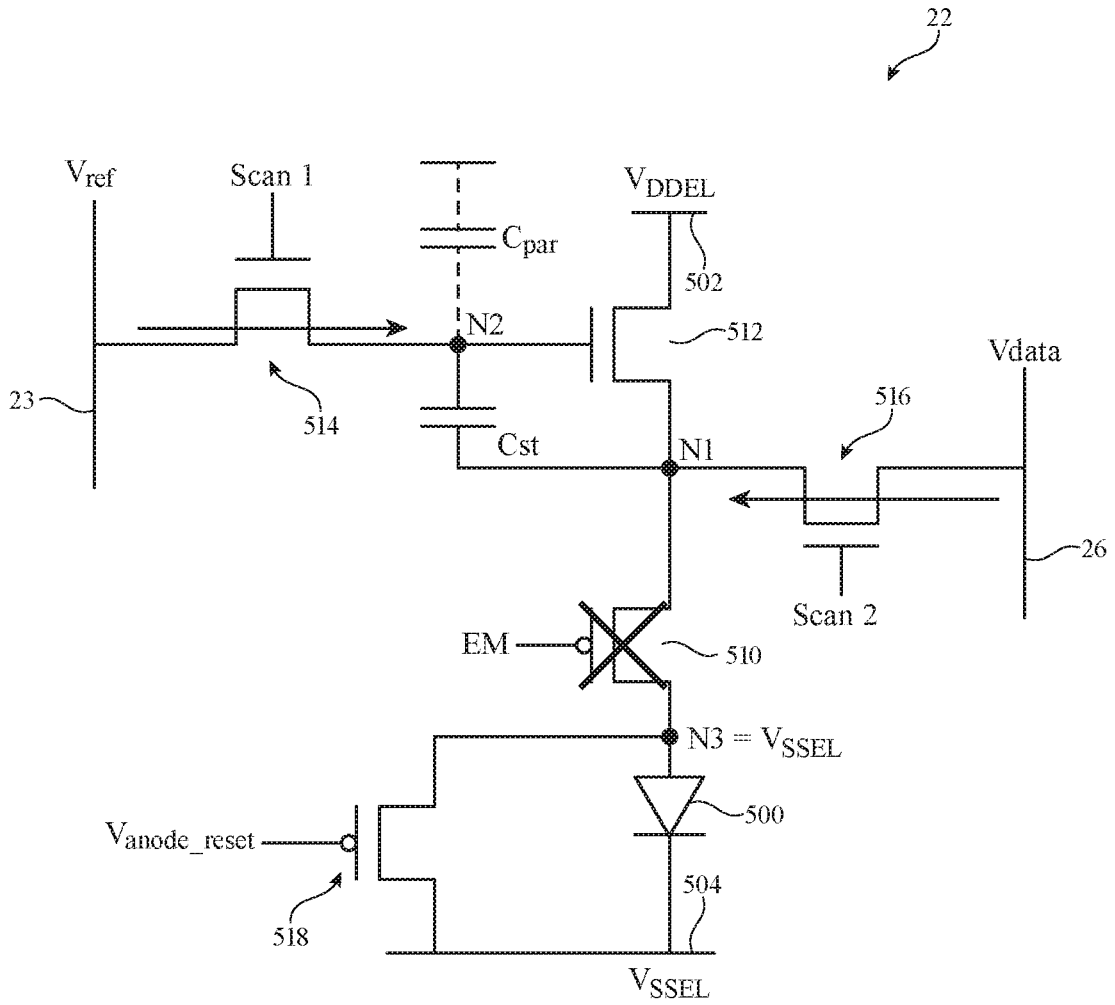
FIGS. 5A-5C show different snapshots of an illustrative display pixel having an anode reset transistor configured to eliminate any hysteresis-induced current sensing error in accordance with an embodiment.
Figure 5B:
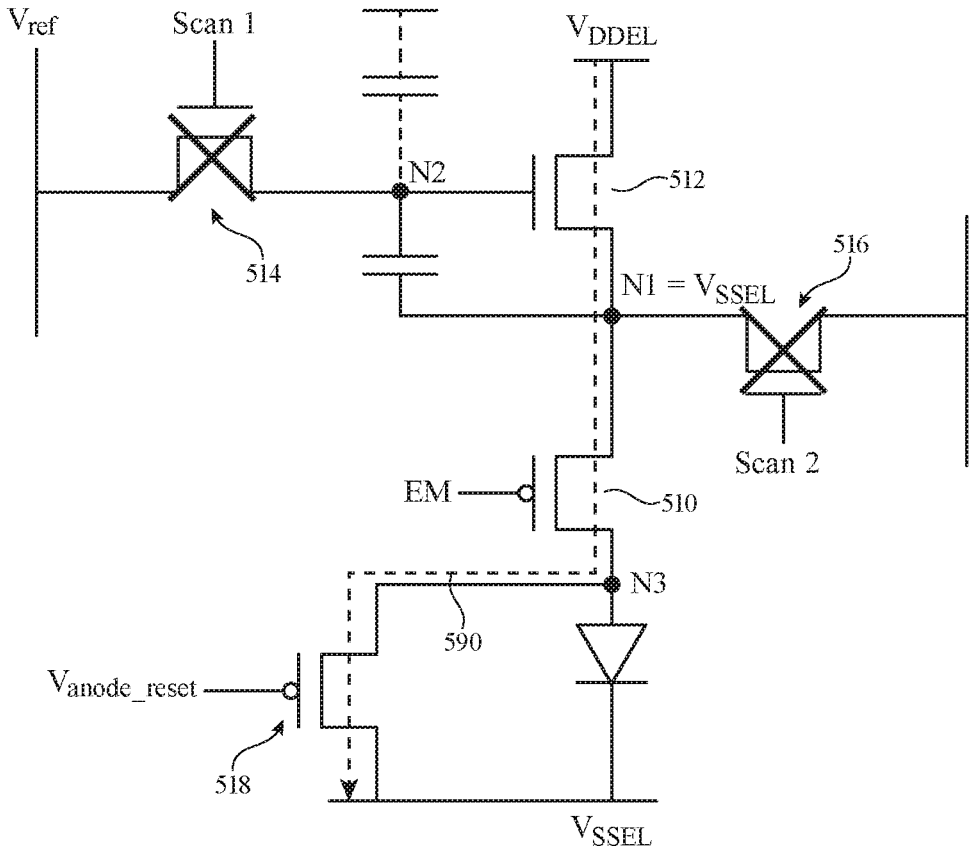
Figure 5C:
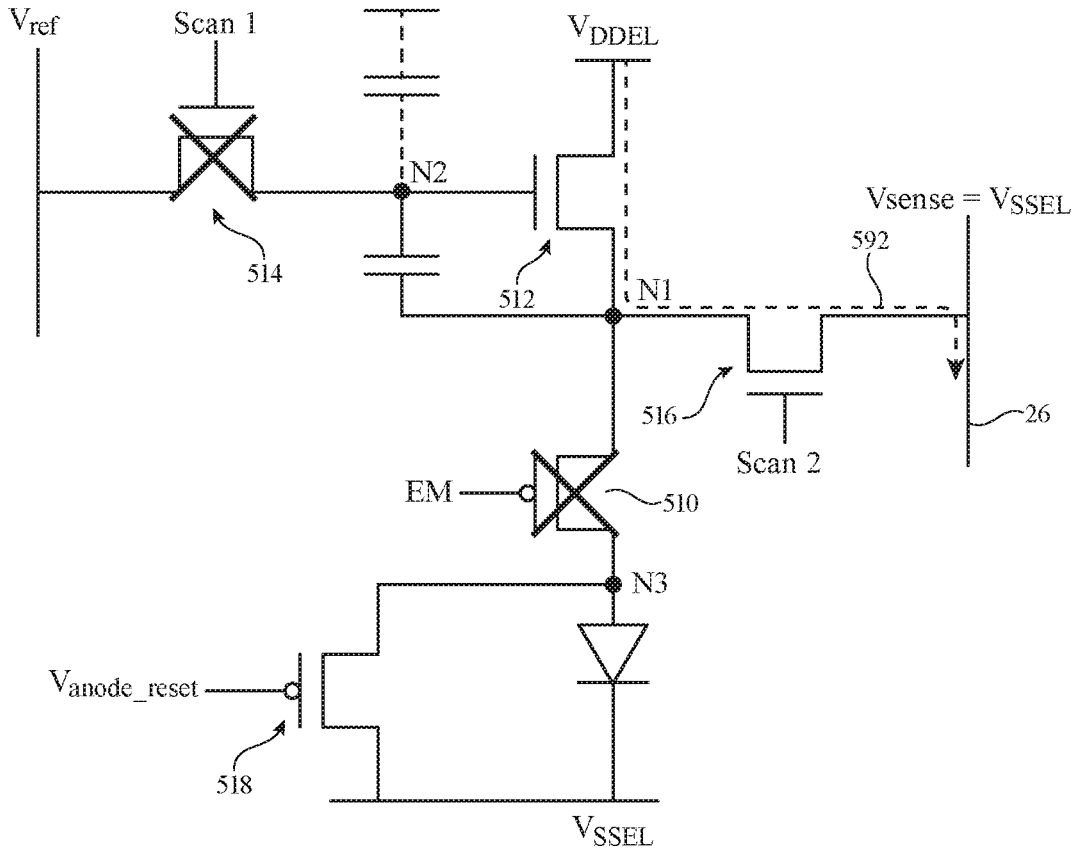

In accordance with an embodiment, display pixel 22 may be provided with an anode reset transistor that is continuously turned on during pixel conditioning and current sensing operations to help mitigate the impacts of hysteresis. FIGS. 5A-5C show different snapshots of an illustrative display pixel 22 having an anode reset transistor 518 configured to eliminate hysteresis-induced current sensing error. As shown in FIG. 5A, pixel 22 includes an organic light-emitting diode (OLED) 500, n-channel thin-film transistors 512, 514, and 516, p-channel thin-film transistors 510 and 518, and storage capacitor Cst. Transistor 512 is sometimes referred to as the "drive" transistor since the amount of voltage stored across the gate and source terminals of transistor 512 determines the amount of current that is allowed to flow through OLED 500.

Transistors 512 and 510 and diode 500 may be coupled in series between a first power supply line 502 (e.g., a positive power supply line on which positive power supply voltage VDDEL is provided) and a second power supply line 504 (e.g., a ground power supply line on which ground voltage VSSEL is provided). Diode 500 has a cathode terminal coupled to power supply line 504 and an anode terminal coupled to node N3. Transistor 510 has a gate terminal that receives an emission control signal EM provided over an emission control line. Transistor 510 is therefore sometimes referred to as an emission control transistor or an emission transistor. Storage capacitor Cst may have a first terminal coupled to the gate terminal of drive transistor 512 and a second terminal coupled to the source terminal of drive transistor 512. Additional parasitic capacitance that is present at the gate terminal of transistor 512 is lumped together and collectively represented as capacitance Cpar in FIG. 5A.

Transistor 514 has a drain terminal coupled to column line 23 (e.g., a shared path on which a reference voltage Vref is provided to each pixel 22 along a given column) and a source terminal coupled to the gate terminal of drive transistor 512. The gate terminal of drive transistor 512 is labeled as node N2. Transistor 514 has a gate terminal that receives a first scan control signal Scan1 via a first scan control line and is selectively turned on by asserting signal Scan1 to set the gate voltage of drive transistor 312 to a predetermined voltage level (e.g., to voltage level Vref). Transistor 514 is therefore sometimes referred to as a gate voltage setting transistor.

Transistor 516 has a drain terminal coupled to column line 26 (e.g., a data line that is coupled to column driver circuitry 20) and a source terminal coupled to the source terminal of drive transistor 512. The source terminal of drive transistor 312 is labeled as node N1. Transistor 516 has a gate terminal that receives a second scan control signal Scan2 via a second scan control line and is selectively turned on by asserting signal Scan2 to load a data signal into pixel 22. Transistor 516 is therefore sometimes referred to as a data loading transistor.

The anode terminal of diode 500 is labeled as node N3. In particular, transistor 518 has a source terminal coupled to node N3, a drain terminal coupled to power supply line 504, and a gate terminal configured to receive anode reset control signal Vanode_reset. Since transistor 518 is a p-channel transistor, transistor 518 may be turned on by asserting signal Vanode_reset (i.e., by driving Vanode_reset low). Transistor 518 is therefore sometimes referred to as the anode reset transistor. Anode reset transistor 518 may be constantly turned on during pixel conditioning and current sensing operations to prevent any hysteresis impact.

The example of FIG. 5A in which thin-film transistors 510, 512, 514, and 516 are implemented as n-channel or n-type transistors while thin-film transistors 510 and 518 are implemented as p-channel or p-type transistors is merely illustrative and is not intended to limit the scope of the present embodiments. If desired, at least some of the n-channel transistors may instead be implemented as p-channel transistors, at least some of the p-channel transistors may instead be implemented as n-channel transistors, all of the transistors within pixel 22 may be implemented using n-channel thin-film transistors, or all of the transistors within pixel 22 may be implemented using p-channel thin-film transistors. In yet other embodiments, pixel 22 may include more than one discrete capacitor component in additional to storage capacitor Cst.

Prior to sensing, display pixel 22 has to be first preconditioned with the desired data value, which can vary from a low or even negative voltage level below VSSEL to a high positive voltage level at or around VDDEL. FIG. 5A illustrates a first phase of pixel conditioning during which a data voltage Vdata is loaded into pixel 22 (e.g., the data programming phase of pixel conditioning operations). During the data programming phase, emission transistor 510 is turned off by deasserting emission control signal EM (e.g., by driving EM high since transistor 510 is active low) while transistor 514 is turned on to bias node N2 to voltage level Vref (e.g., by asserting or pulsing high scan control signal Scan1) and while transistor 516 is turned on to bias node N1 to load data voltage Vdata onto node N1 (e.g., by asserting or pulsing high scan control signal Scan2). Operated in this way, a certain amount of voltage is stored across the gate and source terminals of transistor 512 across capacitor Cst. In this example, the gate-to-source voltage Vgs of drive transistor 512 may be equal to Vref minus Vdata.

In particular, note that anode reset transistor 518 is turned on during the first phase of pixel conditioning. Turning on anode reset transistor 518 during this time would drive node N3 to voltage VSSEL.

FIG. 5B illustrates a second phase of pixel conditioning during which transistors 514 and 516 are turned off (i.e., by deasserting or driving low both scan control signals Scan1 and Scan2). In contrast to the example of FIG. 3B, however, emission transistor 510 is turned on by asserting or driving low emission control signal EM. Since anode reset transistor 518 remains on during the entirety of the pixel conditioning operations, current is allowed to flow through transistors 512, 510, and 518 as indicated by current path 590. Configured in this way, transistors 510 and 518 may pull node N1 down to VSSEL (e.g., node N1 may be driven to VSSEL by the end of the pixel conditioning operations).

Assuming VSSEL is less than Vdata, the voltage at node N1 may decrease by a first amount. Since the voltage across capacitor Cst has nowhere to discharge at this time, node N2 will also be pushed downwards. Due to the existence of parasitic capacitance Cpar at node N2 (which acts like a capacitive divider), however, the amount of voltage decrease at node N2 will be relatively less than that of node N1. The net result is that the gate-to-source voltage Vgs of drive transistor 312 will actually increase during this time period after transistors 514 and 516 are shut off.

Pixel conditioning operations will then be followed by current sensing operations (see, e.g., FIG. 5C). During sensing operations, emission transistor 510 is turned off by deasserting or driving high emission control signal EM, and transistor 516 will be turned on by asserting scan control signal Scan2 (e.g., by temporarily pulsing Scan2 high). Anode reset transistor 518 remains turned on during the current sensing phase, but this need not be the case. If desired, anode reset transistor 518 may also be turned off. During this time, a sensing voltage Vsense will be applied onto data line 26 (e.g., using bias circuitry 27 of FIG. 2), and a current will flow through transistors 512 and 516 as indicated by current path 592. Transistor 516 is therefore sometimes referred to as a current sensing transistor.

In particular, the sensing voltage Vsense may be set equal to voltage VSSEL (i.e., Vsense=VSSEL). Biasing data line 26 to VSSEL during current sensing ensures that node N1 remains unchanged when pixel 22 transitions from pixel conditioning to current sensing operations since node N1 was previously biased to VSSEL as shown in FIG. 5B. If node N1 remains unchanged when transistor 516 is turned on, the gate-to-source voltage Vgs of drive transistor 512 stays constant, so the threshold voltage of transistor 512 will also stay constant. As long as the threshold voltage of drive transistor 512 remains unperturbed, then there will be no hysteresis impact and the corresponding current 592 sensed through column 26 will be accurate (i.e., there will be no hysteresis-induced current sensing error).

Figure 6:
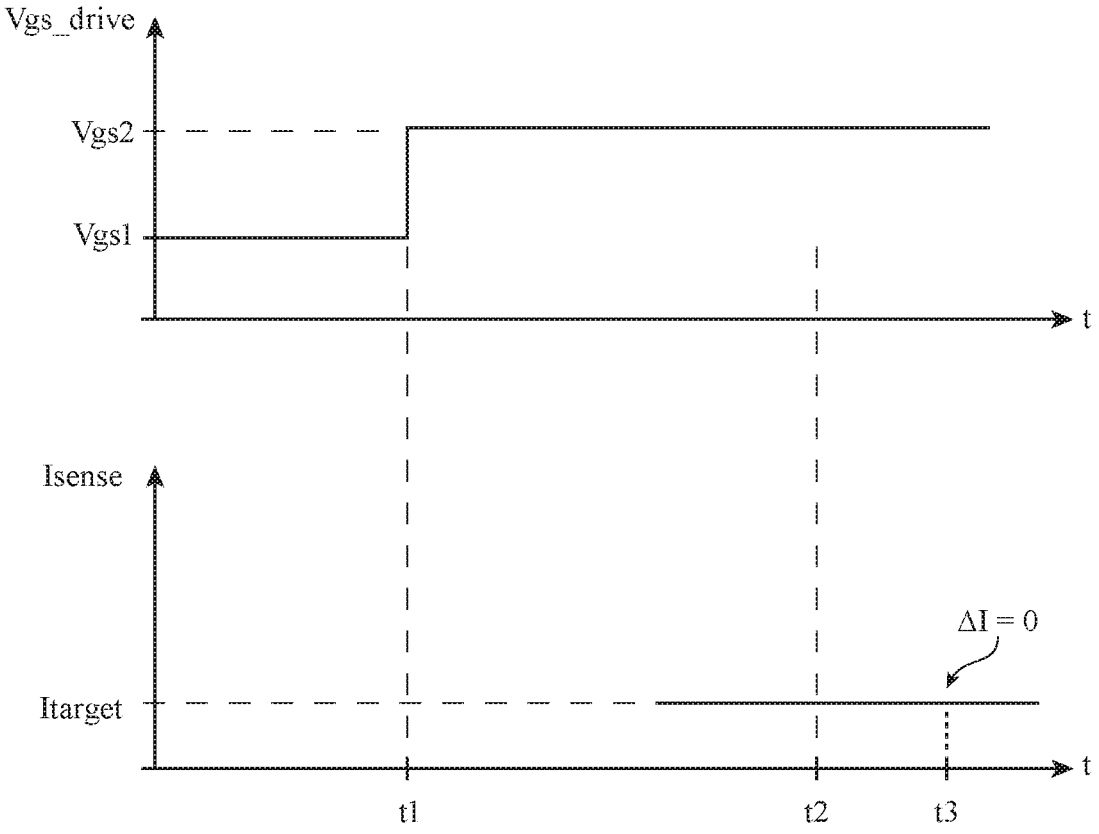
FIG. 6 is a timing diagram illustrating how the illustrative display pixel shown in FIG. 5A-5C exhibits no current sensing error from hysteresis in accordance with an embodiment.

FIG. 6 is a timing diagram illustrating how pixel 22 shown in FIGS. 5A-5C exhibits no current sensing error from hysteresis. Prior to time t1 (which corresponding to the first phase of the pixel conditional operations shown in FIG. 5A), transistors 514 and 516 are turned on to charge the gate-to-source voltage of the drive transistor Vgs_drive to a first voltage level Vgs1.

At time t1 (which correspond to the second phase of the pixel conditioning operations shown in FIG. 5B), transistors 514 and 516 are turned off, and emission transistor 510 is turned on. During this time, transistors 510 and 518 pulls node N1 down to VSSEL, which effectively increases Vgs_drive to a second voltage level Vgs2, as described above in connection with FIG. 5B.

At time t2 (which corresponds to the end of pixel conditioning and the start of current sensing operations), emission transistor 510 is turned off while transistor 516 is turned on to apply the sensing voltage Vsense to node N1. Since Vsense is biased equal to VSSEL (as shown in FIG. 5C), there is no voltage change at node N1 since node N1 was already previously driven to VSSEL by anode reset transistor 518. Thus, at time t2, the gate-to-source voltage of the drive transistor Vgs_drive remains unperturbed at Vgs2. If Vgs_drive remains unchanged at time t2, the current being sensed through line 26 will remain fixed at the target current level Itarget (as shown in the bottom plot of FIG. 6). Assuming current sensing measurements are taken soon after at time t3, there will be no hysteresis-induced current sensing error ΔI. Since sensing error ΔI is zero, the accuracy of current sensing operations and therefore the efficacy of the external compensation scheme performed by compensation circuitry 17 of FIG. 2 is dramatically improved.

Figure 7:
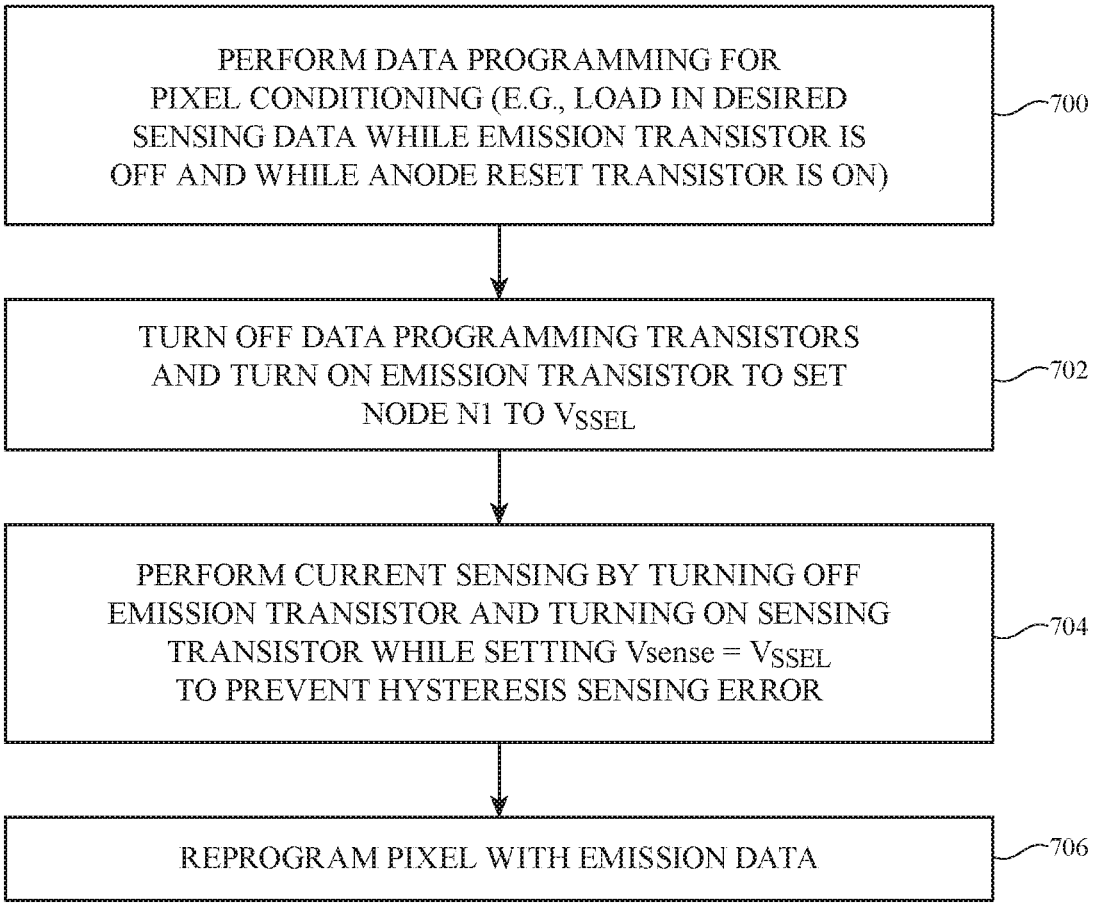
FIG. 7 is a flow chart of illustrative steps for operating the display pixel of FIGS. 5A-5C in accordance with an embodiment.

FIG. 7 is a flow chart of illustrative steps for operating the display pixel of FIGS. 5A-5C in accordance with an embodiment. At step 700, display pixel 22 may be configured to perform the data programming phase for pixel conditioning. This is accomplished by turning on both transistors 514 and 516 while emission transistor 510 is turned off. Anode reset transistor 518 may be turned on during this period to drive node N3 to power supply voltage VSSEL.

At step 702, pixel 22 may be configured to perform the second phase of pixel conditioning, wherein transistors 514 and 516 are both turned off while emission transistor 510 is turned on. Since anode reset transistor 518 remains on during this time, transistors 510 and 518 may drive node N1 to power supply voltage VSSEL.

At step 704, pixel 22 may be configured to perform current sensing operations by turning off emission transistor 510 and turning on current sensing transistor 516 while setting the sensing voltage Vsense equal to VSSEL. Operated in this way, there will be no voltage change at node N1, and hysteresis sensing error is minimized. Subsequently, at step 706, pixel 22 may be reprogrammed with emission data. In general, the pixel conditioning and current sensing operations shown in FIG. 7 can be performed in the factory, in real time (e.g., during blanking intervals between successive image frames), when the display is idle, periodically, aperiodically, when initiated by the user, or at other suitable intervals.

The exemplary pixel architectures shown in FIGS. 5A-5C that include five transistors, one capacitor, one emission control line, and various scan control lines are merely illustrative. If desired, the techniques described herein may be extended or applied to pixel structures that include any number of semi-conducting oxide or silicon transistors, any number of capacitors, more than one emission line, fewer than two scan control lines or more than two scan control lines, and other suitable display pixel architectures.

Figure 8A:
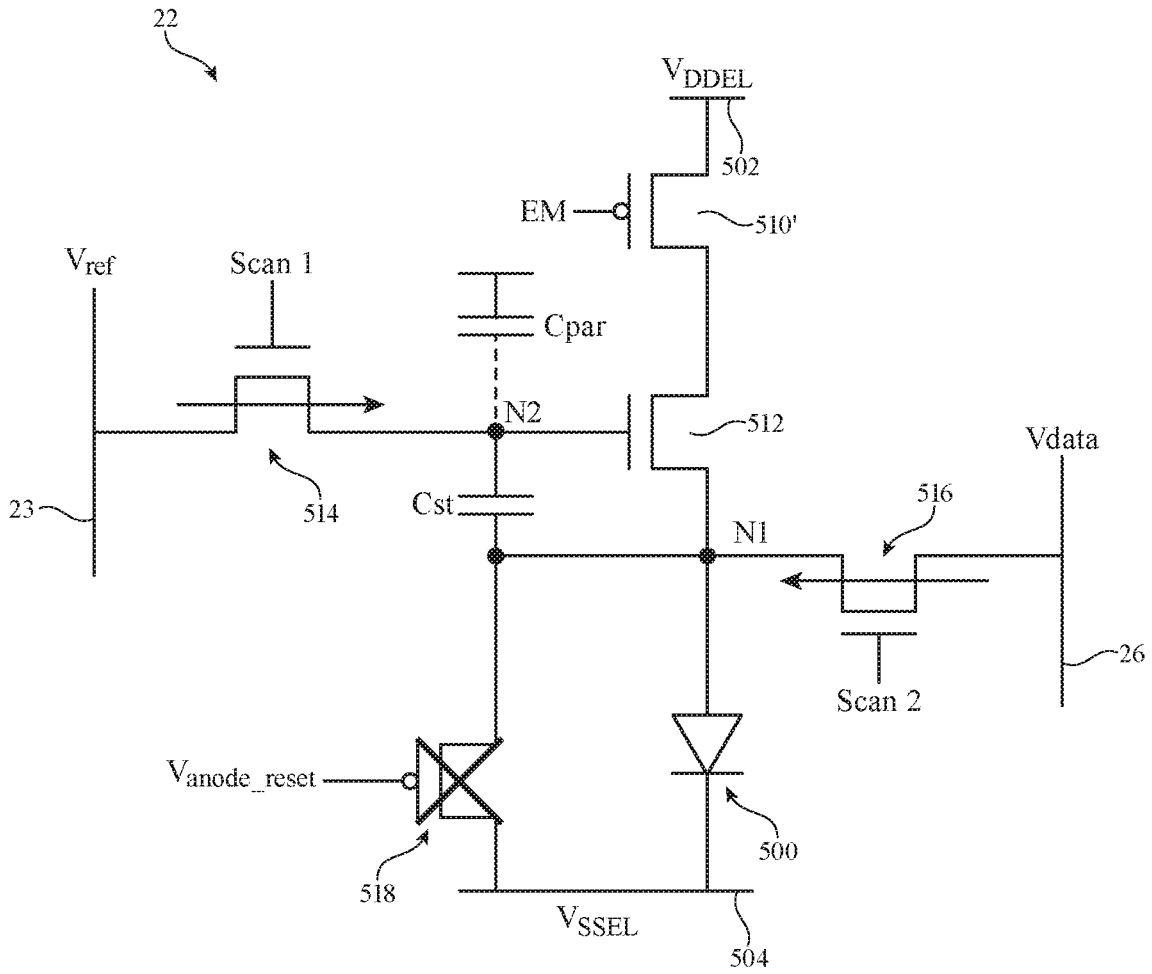
FIGS. 8A-8C show different snapshots of another suitable display pixel having an anode reset transistor configured to eliminate hysteresis-induced current sensing error in accordance with an embodiment.

The example of FIG. 5 in which the emission transistor 510 is interposed between drive transistor 512 and diode 500 and where anode reset transistor 518 is constantly turned on during pixel conditioning operations is merely illustrative. In another suitable arrangement, the emission transistor may instead be interposed between positive power supply terminal 502 and drive transistor 512 (see, e.g., FIG. 8A). As shown in FIG. 8A, emission transistor 510' has a drain terminal coupled to power supply terminal 502 and a source terminal coupled to the drain terminal of drive transistor 512. As a result, the source terminal of drive transistor (i.e., node N1) is directly connected to the anode of diode 500 and to the source terminal of anode reset transistor 518. In other words, node N1 and N3 has collapsed or merged into a single node.

Prior to sensing, display pixel 22 has to be first preconditioned with the desired data value, which can vary from a low or even negative voltage level below VSSEL to a high positive voltage level at or around VDDEL. FIG. 8A illustrates a first phase of pixel conditioning during which a data voltage Vdata is loaded into pixel 22 (e.g., the data programming phase of pixel conditioning operations). During the data programming phase, emission transistor 510' is turned on by asserting emission control signal EM (e.g., by driving EM low since transistor 510' is active low) to drive the drain terminal of drive transistor 512 to VDDEL while transistor 514 is turned on to bias node N2 to voltage level Vref (e.g., by asserting or pulsing high scan control signal Scan1) and while transistor 516 is turned on to bias node N1 to load data voltage Vdata onto node N1 (e.g., by asserting or pulsing high scan control signal Scan2). Operated in this way, a certain amount of voltage is stored across the gate and source terminals of transistor 512 across capacitor Cst. In this example, the gate-to-source voltage Vgs of drive transistor 512 may be equal to Vref minus Vdata.

In particular, note that anode reset transistor 518 will have to be turned off during the first phase of pixel conditioning to allow Vdata to be loaded into node N1. Otherwise, anode reset transistor 518 will fight against transistor 516 to try to drive node N1 towards VSSEL.

Figure 8B:
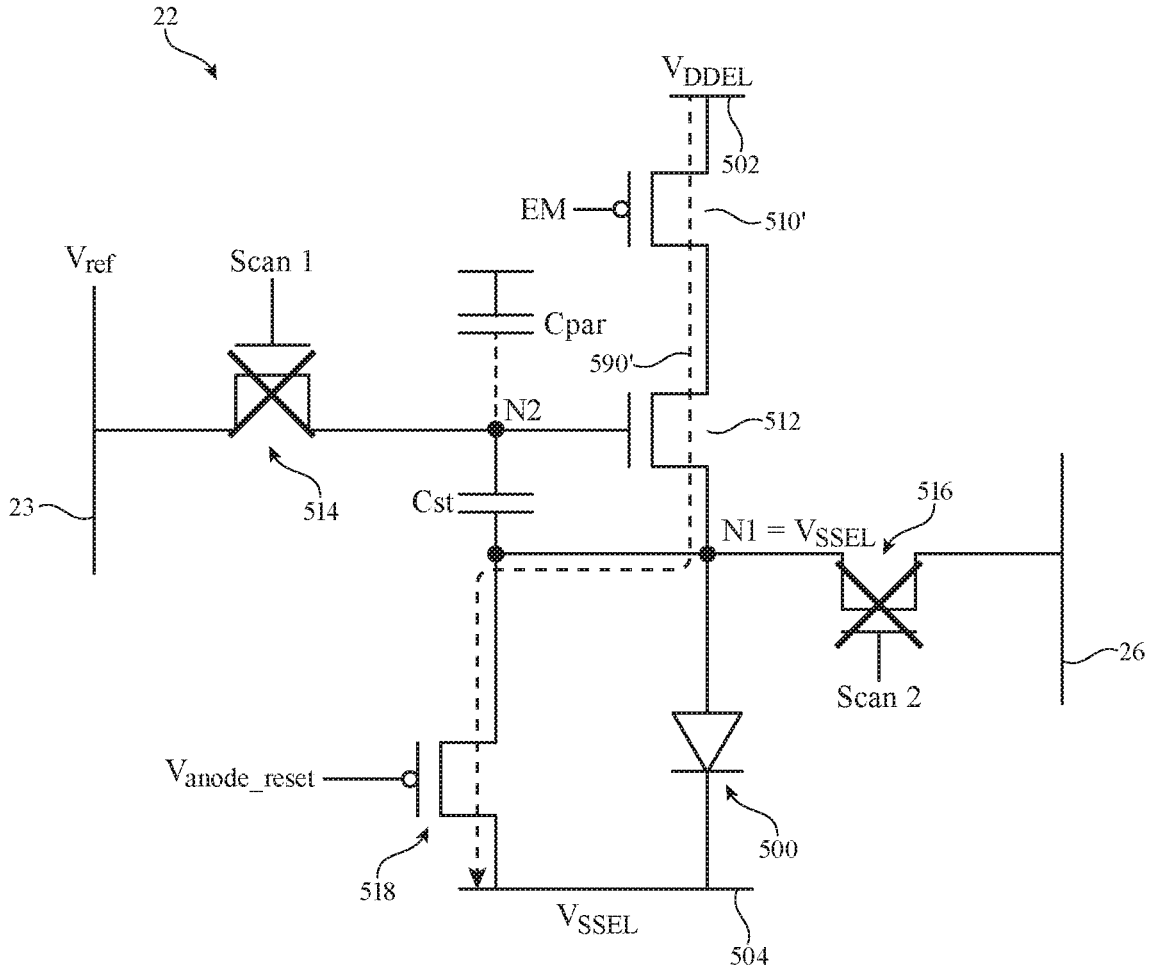

FIG. 8B illustrates a second phase of pixel conditioning during which transistors 514 and 516 are turned off (i.e., by deasserting or driving low both scan control signals Scan1 and Scan2). Emission transistor 510' remains on during the second phase. Anode reset transistor 518 is now turned on by asserting or driving low signal Vanode_reset so that current is allowed to flow through transistors 510', 512, and 518 as indicated by current path 590'. Configured in this way, transistor 518 may pull node N1 down to VSSEL (e.g., node N1 may be driven to VSSEL by the end of the pixel conditioning operations).

Assuming VSSEL is less than Vdata, the voltage at node N1 may decrease by a first amount. Since the voltage across capacitor Cst has nowhere to discharge at this time, node N2 will also be pushed downwards. Due to the existence of parasitic capacitance Cpar at node N2 (which acts like a capacitive divider), however, the amount of voltage decrease at node N2 will be relatively less than that of node N1. The net result is that the gate-to-source voltage Vgs of drive transistor 312 will actually increase during this time period after transistors 514 and 516 are shut off.

Figure 8C:
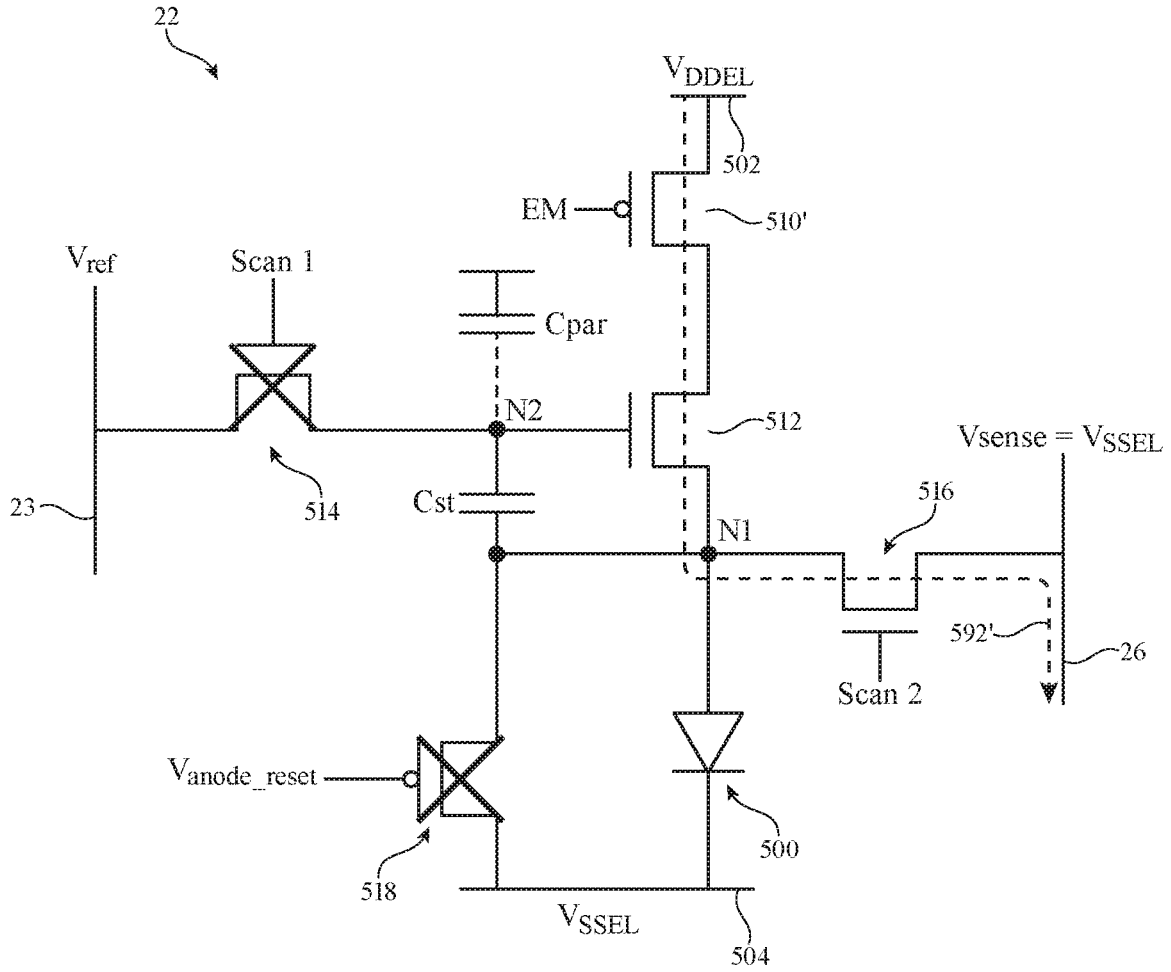

Pixel conditioning operations will then be followed by current sensing operations (see, e.g., FIG. 8C). During sensing operations, anode reset transistor 518 is turned off by deasserting or driving high signal Vanode_reset, and transistor 516 will be turned on by asserting scan control signal Scan2 (e.g., by temporarily pulsing Scan2 high). During this time, a sensing voltage Vsense will be applied onto data line 26 (e.g., using bias circuitry 27 of FIG. 2), and a current will flow through transistors 512 and 516 as indicated by current path 592'. In particular, the sensing voltage Vsense may be set equal to voltage VSSEL (i.e., Vsense=VSSEL). Biasing data line 26 to VSSEL during current sensing ensures that node N1 remains unchanged when pixel 22 transitions from pixel conditioning to current sensing operations since node N1 was previously biased to VSSEL as shown in FIG. 8B. If node N1 remains unchanged when transistor 516 is turned on, the gate-to-source voltage Vgs of drive transistor 512 stays constant, so the threshold voltage of transistor 512 will also stay constant. As long as the threshold voltage of drive transistor 512 remains unperturbed, then there will be no hysteresis impact and the corresponding current 592' sensed through column 26 will be accurate (i.e., there will be no hysteresis-induced current sensing error). The resulting waveforms produced by pixel 22 of FIGS. 8A-8C is identical to those already shown and described in connection with FIG. 6.

Figure 9A:
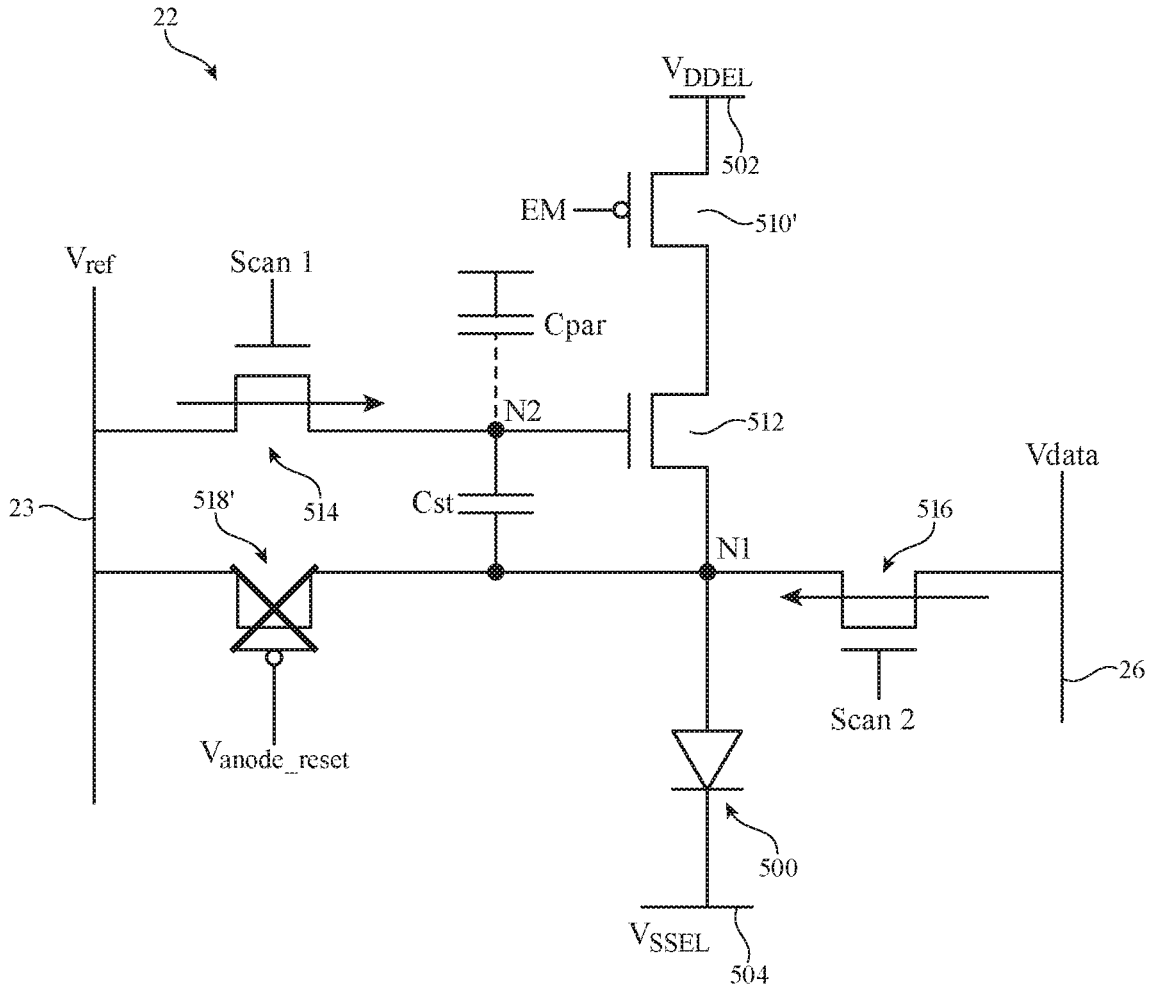
FIGS. 9A-9C show different snapshots of another suitable display pixel having an anode reset transistor configured to eliminate hysteresis-induced current sensing error in accordance with an embodiment.

The example of FIG. 8 in which the anode reset transistor is coupled between node N1 and power supply terminal 504 is merely illustrative. In yet another suitable arrangement, the anode reset transistor may instead be coupled between node N1 and column reference line 23 (see, e.g., FIG. 9A). As shown in FIG. 9A, anode reset transistor 518' has a source terminal coupled to reference line 23 and a drain terminal coupled to node N1. Configured in this way, anode reset transistor 518' may be configured to reset node N1 to reference voltage Vref instead of VSSEL.

Prior to sensing, display pixel 22 has to be first preconditioned with the desired data value, which can vary from a low or even negative voltage level below VSSEL to a high positive voltage level at or around VDDEL. FIG. 9A illustrates a first phase of pixel conditioning during which a data voltage Vdata is loaded into pixel 22 (e.g., the data programming phase of pixel conditioning operations). During the data programming phase, emission transistor 510' is turned on by asserting emission control signal EM (e.g., by driving EM low since transistor 510' is active low) to drive the drain terminal of drive transistor 512 to VDDEL while transistor 514 is turned on to bias node N2 to voltage level Vref (e.g., by asserting or pulsing high scan control signal Scan1) and while transistor 516 is turned on to bias node N1 to load data voltage Vdata onto node N1 (e.g., by asserting or pulsing high scan control signal Scan2). Operated in this way, a certain amount of voltage is stored across the gate and source terminals of transistor 512 across capacitor Cst. In this example, the gate-to-source voltage Vgs of drive transistor 512 may be equal to Vref minus Vdata.

In particular, note that anode reset transistor 518' will have to be turned off during the first phase of pixel conditioning to allow Vdata to be loaded into node N1. Otherwise, anode reset transistor 518' will fight against transistor 516 to try to drive node N1 towards Vref.

Figure 9B:
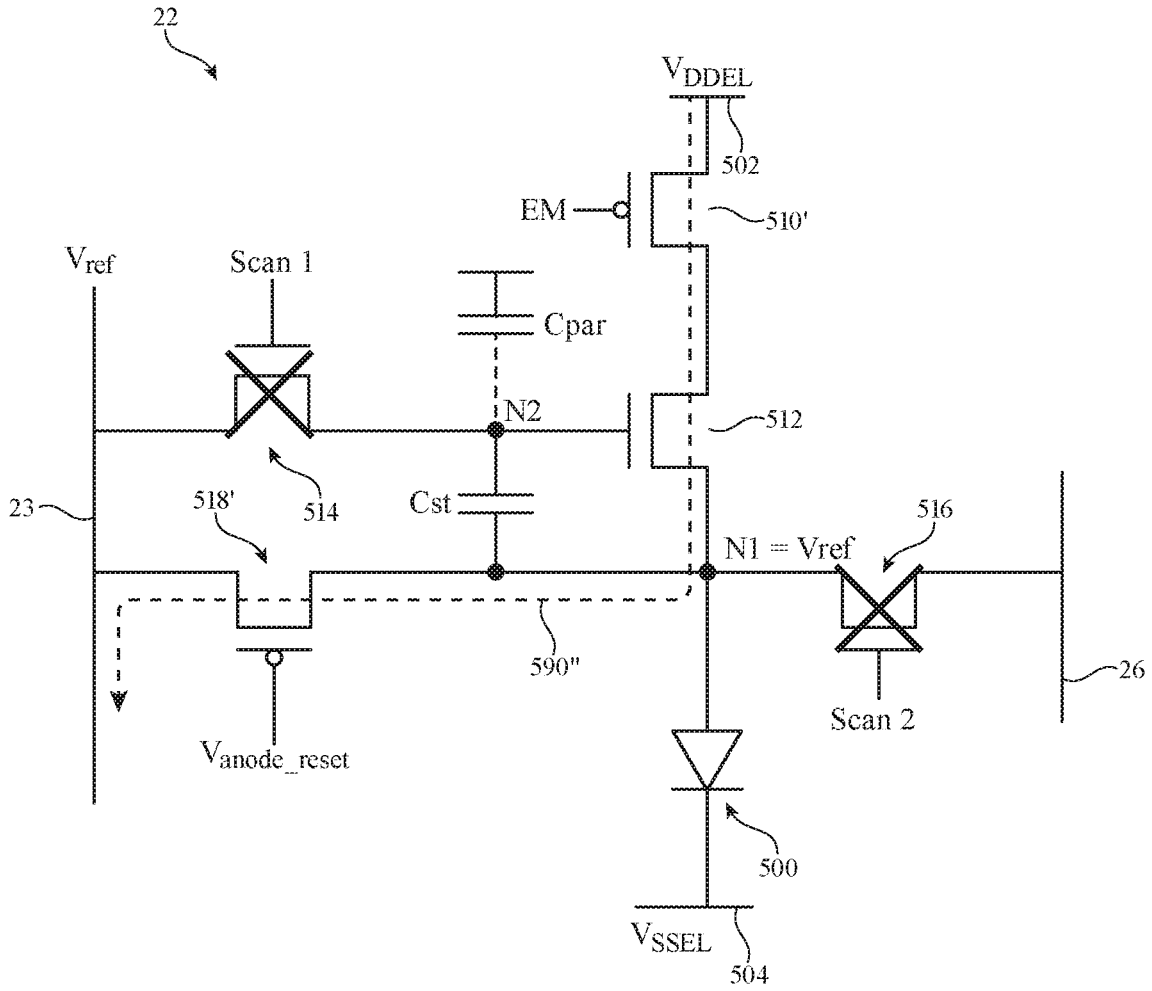

FIG. 9B illustrates a second phase of pixel conditioning during which transistors 514 and 516 are turned off (i.e., by deasserting or driving low both scan control signals Scan1 and Scan2). Emission transistor 510' remains on during the second phase. Anode reset transistor 518' is now turned on by asserting or driving low signal Vanode_reset so that current is allowed to flow through transistors 510', 512, and 518' as indicated by current path 590". Configured in this way, transistor 518' may drive node N1 to Vref (e.g., node N1 may be driven to Vref by the end of the pixel conditioning operations).

Figure 9C:
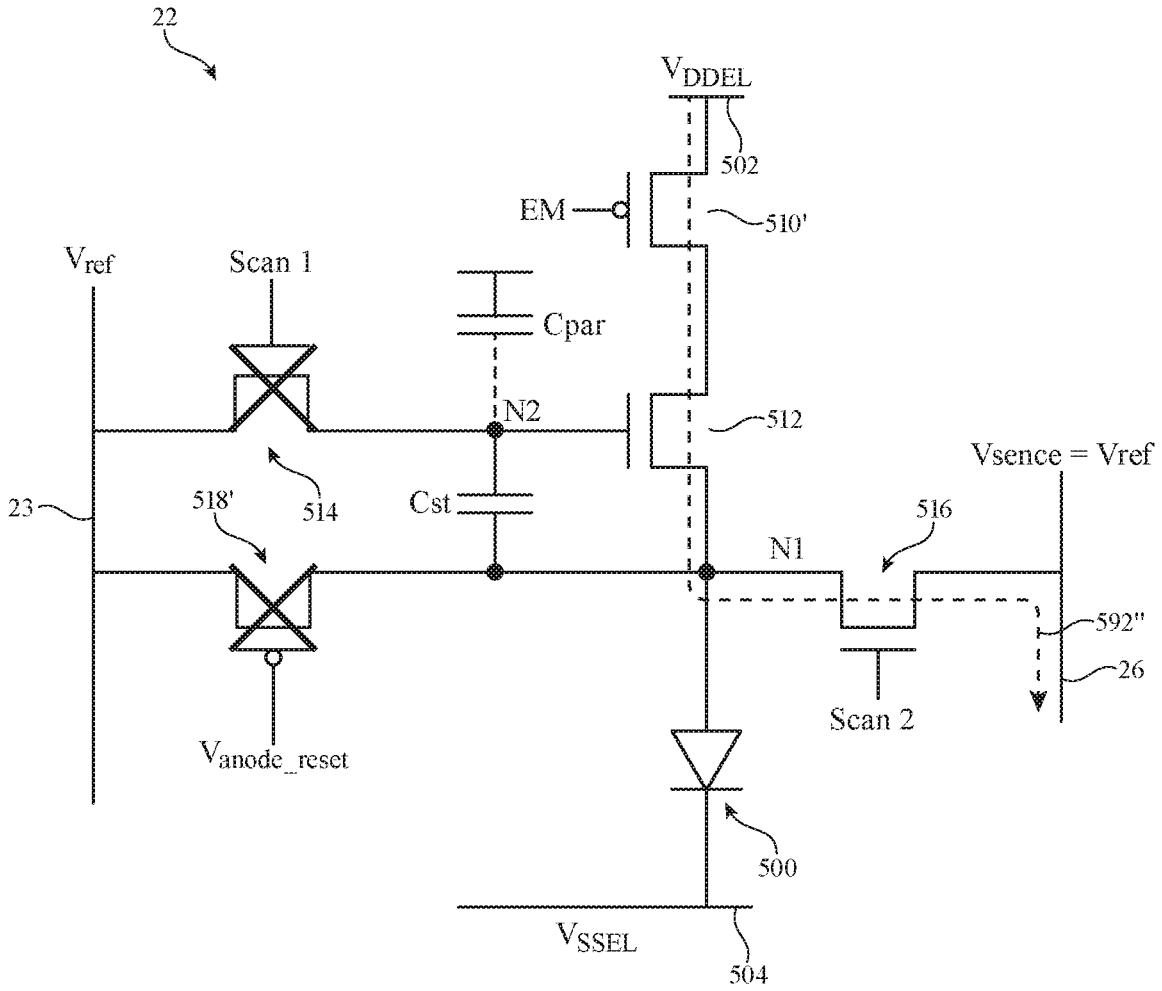

Pixel conditioning operations will then be followed by current sensing operations (see, e.g., FIG. 9C). During sensing operations, anode reset transistor 518' is turned off by deasserting or driving high signal Vanode_reset, and transistor 516 will be turned on by asserting scan control signal Scan2 (e.g., by temporarily pulsing Scan2 high). During this time, a sensing voltage Vsense will be applied onto data line 26 (e.g., using bias circuitry 27 of FIG. 2), and a current will flow through transistors 512 and 516 as indicated by current path 592". In particular, the sensing voltage Vsense may be set equal to voltage Vref (i.e., Vsense=Vref). Biasing data line 26 to Vref during current sensing ensures that node N1 remains unchanged when pixel 22 transitions from pixel conditioning to current sensing operations since node N1 was previously biased to Vref as shown in FIG. 9B. If node N1 remains unchanged when transistor 516 is turned on, the gate-to-source voltage Vgs of drive transistor 512 stays constant, so the threshold voltage of transistor 512 will also stay constant. As long as the threshold voltage of drive transistor 512 remains unperturbed, then there will be no hysteresis impact and the corresponding current 592" sensed through column 26 will be accurate (i.e., there will be no hysteresis-induced current sensing error). The resulting waveforms produced by pixel 22 of FIGS. 9A-9C is identical to those already shown and described in connection with FIG. 6.

The foregoing is merely illustrative and various modifications can be made by those skilled in the art without departing from the scope and spirit of the described embodiments. The foregoing embodiments may be implemented individually or in any combination.

What is claimed is:

1. A display pixel, comprising:

an organic light-emitting diode having an anode and a cathode;

a drive transistor coupled in series with the organic light-emitting diode, wherein the drive transistor has a drain terminal, a gate terminal, and a source terminal;

an anode reset transistor directly coupled to the anode of the organic light-emitting diode, wherein the anode reset transistor is configured to drive the source terminal of the drive transistor to a given voltage during pixel conditioning operations;

a data line; and a current sensing transistor coupled between the data line and the source terminal of the drive transistor, wherein the current sensing transistor is configured to output sensing current onto the data line during current sensing operations while the data line is biased to the given voltage to reduce hysteresis-induced current sensing error.

2. The display pixel of claim 1, wherein the voltage at the source terminal of the drive transistor remains unperturbed when the display pixel transitions from the pixel conditioning operations to the current sensing operations.

3. The display pixel of claim 1, further comprising a storage capacitor coupled across the gate and source terminals of the drive transistor.

4. The display pixel of claim 1, further comprising:

a power supply line directly connected to the cathode of the organic light-emitting diode, wherein the power supply line is biased at the given voltage, and wherein the anode reset transistor has a source terminal coupled to the anode of the organic light-emitting diode and a drain terminal coupled to the cathode of the organic light-emitting diode.

5. The display pixel of claim 4, further comprising:

an emission transistor coupled in series with the drive transistor and the organic light-emitting diode, wherein the emission transistor has a gate terminal configured to receive an emission control signal, and wherein the emission transistor is turned on while the anode reset transistor is configured to drive the source terminal of the drive transistor to the given voltage during the pixel conditioning operations.

6. The display pixel of claim 5, wherein the emission transistor is turned off during a portion of the pixel condition operations when data is loaded into the display pixel, and wherein the emission transistor is also turned off during the current sensing operations.

7. The display pixel of claim 5, wherein the emission transistor is turned on during a portion of the pixel condition operations when data is loaded into the display pixel, and wherein the emission transistor is also turned on during the current sensing operations.

8. The display pixel of claim 1, further comprising:

a reference voltage line, wherein the reference voltage line is biased at the given voltage; and a gate setting transistor having a drain terminal coupled to the reference voltage line, a source terminal directly coupled to the gate terminal of the drive transistor, and a gate terminal configured to receive a scan control signal, wherein the anode reset transistor has a source terminal coupled to the reference voltage line and a drain terminal coupled to the anode of the organic light-emitting diode.

9. The display pixel of claim 8, further comprising:

an emission transistor coupled in series with the drive transistor and the organic light-emitting diode, wherein the emission transistor has a gate terminal configured to receive an emission control signal, and wherein the emission transistor is turned on while the anode reset transistor is configured to drive the source terminal of the drive transistor to the given voltage during the pixel conditioning operations.

10. The display pixel of claim 9, wherein the gate setting transistor is turned on while the anode resetting transistor is turned off during a portion of the pixel condition operations when data is loaded into the display pixel, and wherein the gate setting transistor and the anode reset transistor are turned off during the current sensing operations.

11. A method of operating a display pixel that comprises a drive transistor and an organic light-emitting diode coupled in series with the drive transistor, the method comprising:

during pixel conditioning operations, using an anode reset transistor in the display pixel to drive a source terminal of the drive transistor to a given voltage; and during current sensing operations that immediately follow the pixel conditioning operations, using a current sensing transistor to output a sensing current onto a data line while biasing the data line to the given voltage to reduce hysteresis-induced current sensing error.

12. The method of claim 11, further comprising:

ensuring that the voltage at the source terminal of the drive transistor does not change when the current sensing transistor is turned on at the onset of the current sensing operations.

13. The method of claim 12, wherein the organic light-emitting diode has a cathode that is directly connected to a power supply line that is biased to the given voltage.

14. The method of claim 12, wherein the display pixel further comprises a reference voltage line and a gate setting transistor coupled between the reference voltage line and a gate terminal of the drive transistor, and wherein the reference voltage line is biased to the given voltage level.

15. The method of claim 12, wherein the display pixel further comprises an emission transistor connected in series with the drive transistor and the organic light-emitting diode, the method further comprising:

turning on the emission transistor while the anode reset transistor is used to drive the source terminal of the drive transistor to the given voltage.

16. An electronic device, comprising:

control circuitry; and a display coupled to the control circuitry, wherein the display comprises:

an organic light-emitting diode; and a drive transistor coupled in series with the organic light-emitting diode, wherein the drive transistor has a gate-to-source voltage that is biased to a given voltage level during pixel conditioning operations, and wherein the gate-to-source voltage of the drive transistor remains unperturbed at the start of current sensing operations immediately following the pixel conditioning operations to eliminate hysteresis-induced current sensing error.

17. The electronic device of claim 16, wherein the display further comprises:

an anode reset transistor configured to drive a source terminal of the drive transistor to a given power supply voltage level during the pixel conditioning operations.

18. The electronic device of claim 17, wherein the display further comprises:

a data loading transistor configured to output a sensing current to a corresponding data line during the current sensing operations, wherein the data line is biased to the given power supply voltage during the current sensing operations.

19. The electronic device of claim 18, wherein the anode reset transistor is directly connected to an anode of the organic light-emitting diode, wherein the anode reset transistor is always turned on during the pixel conditioning operations.

20. The electronic device of claim 18, wherein the anode reset transistor is directly connected to a reference voltage line on which a reference voltage is provided.

* * * * *